US005885414A

United States Patent [19]

Lindström et al.

[11] Patent Number: 5,885,414

[45] Date of Patent: Mar. 23, 1999

[54] METHOD OF PRODUCING PULP WITH HIGH ALKALI COOKING IN THE LAST COOKING STAGE

[75] Inventors: Mikael Lindström; Christofer Lindgren, both of Stockholm, Sweden

[73] Assignee: Kvaerner Pulping AB, Sweden

[21] Appl. No.: 914,385

[22] Filed: Aug. 18, 1997

[51] Int. Cl.[6] ..... D21C 3/26

[52] U.S. Cl. ..... 162/19; 162/39; 162/45

[58] Field of Search ..... 162/19, 37, 34, 162/39, 47

[56] References Cited

U.S. PATENT DOCUMENTS

| | | | |
|---|---|---|---|
| 2,639,987 | 5/1953 | Sloman | 162/38 |
| 4,578,149 | 3/1986 | Fagerlund | 162/238 |
| 4,690,731 | 9/1987 | Hartler et al. | 162/45 |
| 5,066,362 | 11/1991 | Meredith | 162/17 |
| 5,183,535 | 2/1993 | Tikka | 162/19 |
| 5,522,958 | 6/1996 | Li | 162/19 |
| 5,635,026 | 6/1997 | Kettunen et al. | 162/19 |

FOREIGN PATENT DOCUMENTS

| | | |
|---|---|---|
| WO 94/11566 | 5/1994 | WIPO . |
| WO 95/32331 | 11/1995 | WIPO . |

OTHER PUBLICATIONS

Paper and Timber vol. 79/No. 4/1997; "Effect of cooking stage EA concentration profiles on softwood kraft pulping" by Kettunen, Ramark, Kimmo Harsia, and Kaj Henricson, pp. 232 through 234, and 236 through 239.

Svensk papperstidning nr 15 1978; "Extended delignification in kraft cooking—a new concept" by Nils Hartler; pp. 483 and 484.

Kettunen et al. "Effect of Cooking . . . kraft Pulping", Paper and Timber, vol. 79, pp. 232–239, Apr. 1997.

*Primary Examiner*—Stanley S. Silverman
*Assistant Examiner*—Dean T. Nguyen
*Attorney, Agent, or Firm*—Fasth Law Offices; Rolf Fasth

[57] ABSTRACT

A method and device for cooking pulp by increasing the effective alkali concentration in the residual phase of the cooking process to substantially improve the residual delignification rate and thus improving the pulp properties such as the pulp strength and pulp yield at a given lignin content.

25 Claims, 6 Drawing Sheets

METHOD OF PRODUCING PULP WITH HIGH ALKALI COOKING IN THE LAST COOKING STAGE

TECHNICAL FIELD

The present invention relates to a novel method and device for producing pulp, with the aid of a high alkali cooking process in the last cooking stage.

BACKGROUND INFORMATION AND SUMMARY OF THE INVENTION

Environmental demands have forced the pulping industry to develop improved cooking and bleaching methods in order to lower the lignin content of the pulp that enters the bleaching stages. This is both environmentally and economically advantageous. Spent liquor from the pulping stages are nowadays often efficiently recovered and recirculated. However, the effluent from the bleaching stages cannot be recovered in the same efficient manner so that the bleaching effluent may still have a negative impact on the environment.

It is, therefore, important to minimize the amount of lignin that has to be removed in the bleaching stages. The delignification in a kraft cook may be considered as a three-stage process; an initial phase involving the rapid removal of about 20% of the lignin; a slower bulk delignification stage; and, finally, an even slower residual delignification stage. The non-selectivity of the delignification, i.e., the decrease in pulp strength and pulp yield that accompany the lignin removal during the residual phase is often one important factor that limits the extent to which the lignin can be removed during the cooking stage in the production of bleached kraft pulp.

In conventional cooking processes, the digester is filled with wood chips and all the cooking liquor, which in the kraft process is an aqueous solution of sodium hydroxide and sodium sulfide, is charged at the beginning of the cooking process. In such processes, the initial alkali concentration is very high and because of the fast consumption of alkali, the concentration decreases rapidly to about one third after about one third of the total cooking time.

The basic understanding of the process kinetics of kraft pulping have suggested that the alkali concentration should be levelled out, i.e., decreased in the beginning of the cook and increased at the end of the cook so that virtually the same alkali level is kept through the cook to improve the selectivity, e.g., to increase the pulp strength at a given lignin content. This understanding has guided the development of many new modified kraft pulping processes.

One recent breakthrough within the field of pulp cooking is ITC™, which was developed in 1992–1993. ITC™ is described in WO-9411566, and shows that very good results regarding the pulp quality can be achieved by using the ITC™ process. This process is based mainly on the idea of using almost the same relatively low temperature in all cooking zones in combination with moderate alkali levels. The ITC™-concept does not merely relate to the equalization of temperatures between different cooking zones, but a considerable contribution of the ITC™-concept relates to enabling an equalized alkali profile also in the lower part of the counter-current cooking zone.

In many conventional systems, the white liquor charge is often split between the impregnation and the cooking stages, so called modified cooking, or the cooking stage is carried out in two parts so that the first part is concurrent and the second part is counter-current so that the alkali charge is divided between the impregnation, concurrent and the counter-current stages in order to keep the sodium hydroxide concentration at the same level. This practice is called modified continuous cooking (MCC). Further improvement may be gained by increasing the temperature in the washing section and adding white liquor to the wash liquid, so called extended modified cooking (EMCC). If the temperature is kept constant in all cooking stages, the process is called isothermal cooking (ITC), as described above.

The implementation of the present invention is possible in production facilities using all of the above mentioned cooking methods and other suitable cooking methods. An important feature of the present invention is that the effective alkali concentration should be substantially increased at the end of the cooking process. Unless otherwise specified, all effective alkali concentrations are measured as NaOH.

The fraction of lignin that is dissolved is surprisingly influenced to a large extent by the hydroxide ion concentration during the cooking process. However, the temperature does not seem to have much effect on the amount of residual lignin. Another important feature of the present invention is that only the hydroxide ion concentration and the temperature seem to have a significant influence on the rate of residual delignification. Hydrosulphide ion concentration only seems to have a marginal or no effect on the rate of residual delignification.

It is to be understood that somewhat different arrangements may be used depending upon, among other things, if an improved pulp production, a decreased lignin content in the pulp or an increased pulp yield or pulp strength is desired.

The method and device of the present invention provides for even better cooking characteristics than the above-described methods. According to the present invention, the cooking process is carried out at a relatively low and equalized alkali concentration to cause the residual lignin content to be relatively high while leaving the valuable cellulose and hemicellulose parts of the raw material mostly intact. The low alkalinity liquor, i.e. the spent liquor, in the digester is replaced with a high alkalinity liquor, i.e. a white liquor, at the end of the cooking process. This results in that the remaining lignin may be removed at a rate equal to that of the more selective bulk delignification phase. This high removal rate makes it possible to substantially increase the total overall selectivity of the kraft cooking stage, e.g., increased pulp yield and pulp strength at a given lignin content.

The novel method and device of the present invention enables the production of pulp that has a high quality and a very good bleachability. This means that bleach chemicals and methods can be chosen with a wider variety than before for achieving the desired quality targets related to brightness, yield, tear strength, viscosity, etc., of the final bleached pulp product.

DETAILED DESCRIPTION

Figure 1:
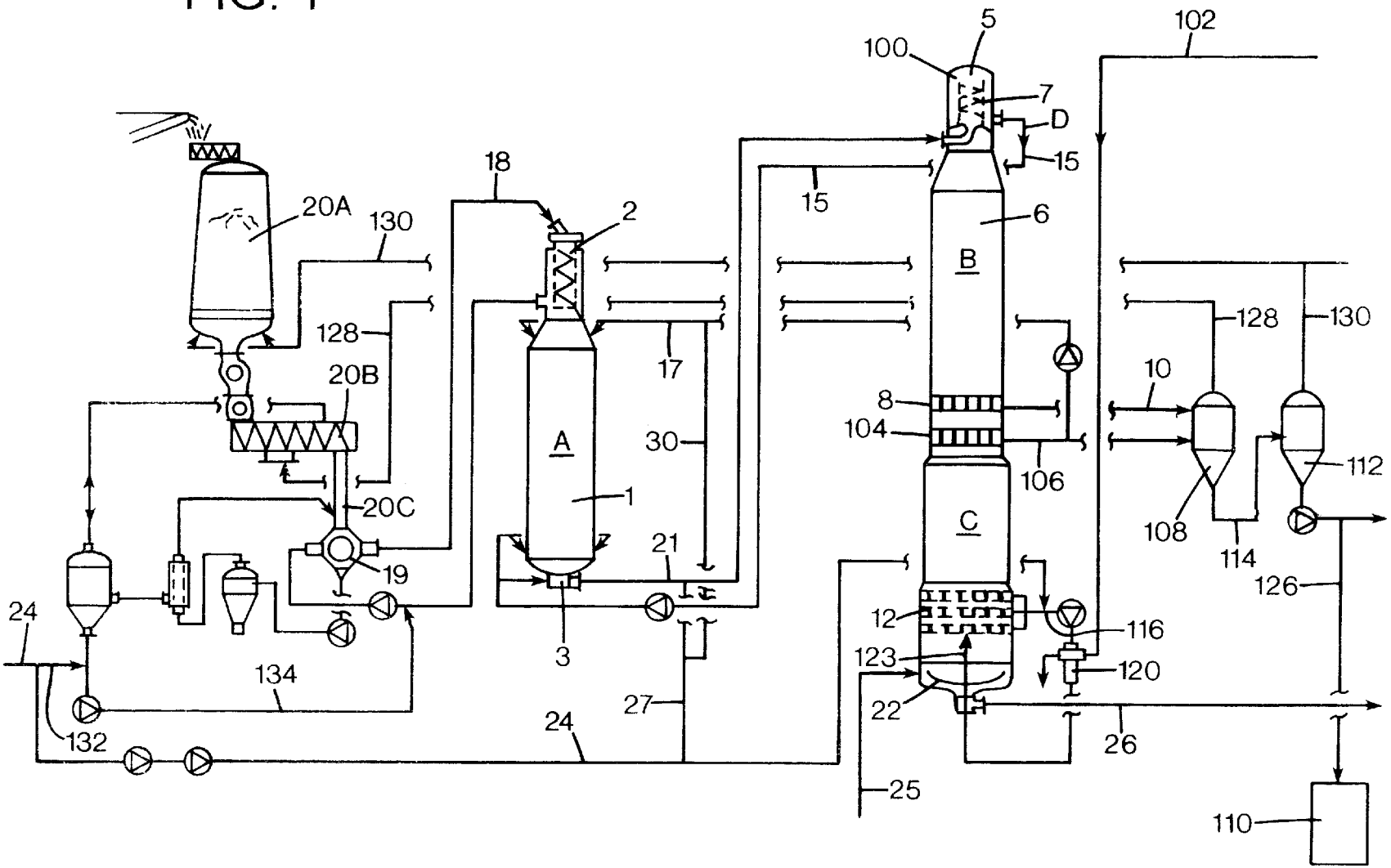
FIG. 1 is a schematic illustration of a preferred first embodiment of a continuous two vessel digesting system according to the present invention.

It is to be understood that the digester system of the present invention may include a steam/liquid-phase continuous digester, hydraulic continuous digester, batch digester or any other suitable type of digester. For example, FIG. 1 shows a preferred first embodiment of a two vessel digester system for producing chemical pulp according to the present invention. The main components of the digester system may consist of an impregnation vessel 1 and a digester 6. The novel pulping process of the present invention may be employed both in continuous and batch digesters and may be used both in existing systems to increase the production and improve the pulp quality or in a new production facility to achieve superior pulp quality and raw material utilization. In a continuous system, the lignocellulosic material, such as a fiber material in the form of chips, is generally pre-steamed at atmospheric pressure followed by a pressure increase and steaming at a super-atmospheric pressure, as described in detail below.

The chips to be impregnated may be fed from a chip bin 20A, through a steaming vessel 20B and a chip chute 20C. A feeding device, preferably a high-pressure feeder 19, may feed the chips via a conduit 18 to the top of the impregnation vessel 1. The feeder 19 may be arranged to a chute, and is preferably connected to all the necessary liquid circulations and replenishment.

The impregnation vessel 1, which normally is totally liquid filled, has an impregnation zone A disposed therein and possesses a feeding-in device 2 at the top, which feeding-in device may be of a conventional type, i.e., a top separator with screw-feed device which feeds the chips in a downward direction at the same time as transport liquid is drawn off. Of course, the screw-feed device may also be of a type that feeds the chips in an upward direction. At the bottom, the impregnation vessel 1 may have a feeding-out device 3 comprising a bottom scraper.

A conduit 21 for transporting the chips and transport liquid extends from the bottom of the impregnation vessel 1 up to a top 5 of the digester 6. A cooking liquor conduit 24 may be connected to the conduit 21 for supplying the conduit 21 with white liquor via a branch conduit 27. From tests made in lab-scale, we have found indications that it is desired to keep the alkali level at above at least 2 g/l, preferably above 4 g/l, in the impregnation vessel 1 in connection with black and white liquor, which would normally correspond to a pH of at least 11. If not, it appears that dissolved lignin precipitate and even condense. The conduit 21 may open out at a bottom portion or a top portion of a top separator 7 which may feed the chips through the separator by using a screw that moves the chips in an upward or downward direction. It is to be understood that the chips may move in any direction that is desired depending upon the type of the digester that is used. A screen of the separator may be used to draw off the transport liquid (which is then returned in line 15) together with which the chips are transported up to the top.

A first screen girdle section 8 is disposed at a bottom of a concurrent zone B of the digester 6 to draw off a substantial portion of the spent liquor. The effective alkali concentration in the concurrent cooking zone B should be kept relatively low. Preferably the effective alkali concentration, measured as NaOH, should be between about 3 g/l and 30 g/l; more preferably between 4 g/l and 20 g/l; and, most preferably, between about 5 g/l and about 15 g/l. Draw-off at this screen girdle section 8 can be conducted directly via a first conduit 10 to a recovery unit 110. Preferably, the spent liquor is conducted to the recovery unit via a first flash tank 108 and a second flash tank 112 to recover some of the heat of the spent liquor. The first flash tank 108 is in fluid communication with the second flash tank via a conduit 114.

A second screen girdle section 104 may be disposed below the first screen girdle section 8. A conduit 106 is operatively attached to the second screen girdle section 104 to draw off spent liquor and conduct the spent liquor via a second conduit 17 back to a top portion of the impregnation vessel 1. The second conduit 17 is operatively connected to the conduit 106. A branch conduit 30 may extend between the second conduit 17 and the cooking liquor conduit 24 to supply white liquor to the second conduit 17 to be mixed with the spent liquor withdrawn from the second screen girdle section before the liquor enters the top of the impregnation vessel 1. A minor portion of the spent liquor drawn off at the second screen girdle section 104 may be conducted to the first flash tank 108.

A third screen girdle section 12 may be disposed below the second screen girdle section 104 at the bottom of the digester 6 so that a counter-current zone C may be defined between the sections 12 and 104. A third conduit 116 may withdraw spent liquor from the screen girdle section 12. The spent liquor from the third screen girdle section 12 and the white liquor supplied by the cooking liquor conduit 24 may be conducted back to the digester 6 via a central pipe 123. The temperature of the liquor in the third conduit 116 may be controlled by a heat exchanger 120 that is supplied with steam from a high pressure steam conduit 102. In this way, the draw-off from the screen girdles 12, may be recirculated (for displacing black liquor in counter-current to the second draw-off screen 104) into the digester with the aid of the central pipe 123 (or alternately a stand pipe from the bottom of the digester) which opens out approximately on a level with the third screen girdle section 12.

At the bottom 10 of the digester, there may be a feeding-out device including one scraping element 22. A washing liquid may be added to the bottom of the digester 6 and then subsequently conducted upwards in counter-current. The third screen girdle section 12 is disposed at a sufficient height above the conduit 25 to permit the attainment of a desired flow from the latter liquid-addition point towards the third screen girdle section 12.

An important feature of the present invention is that the third conduit 116 is also connected to the cooking liquor conduit 24 so that a substantial amount of fresh alkali can be supplied and, in the form of counter-current cooking, further reducing the Kappa number.

In order to facilitate the delignification, the temperature of the washing liquid may be increased so that the temperature in the counter-current cooking zone C is in the range from about 100° C. to about 175° C., preferably 120° C. to 160° C., more preferably from about 130° C. to about 150° C. If the retention time for the partially delignified raw material is at least 30 minutes in the high effective alkali concentration zone C, it is generally advantageous to have a lower temperature in this zone C than in the earlier low effective alkali zone B. The temperature in the concurrent zone B may be between about 130° C. and about 185° C.; more preferably, between about 140° C. and about 175° C.; and, most preferably, between about 150° C. and 170° C.

If the spent liquor from both the concurrent zone B and the counter-current zone C of the cook are extracted at the same point and forwarded to the recovery unit 110, there exists very little or no possibility of using the residual alkali and sulfidity content of the cooking liquor from the counter-current zone C and the digesting process may lead to an increase in the white liquor requirement. This increase may be substantially reduced if the extraction of high effective alkali liquor is separated from the extraction of the low effective alkali liquor destined to be conducted to the recovery system. This separation of extraction may be achieved by placing the screen girdle section 8 some distance apart from the second screen girdle section 104. The separately extracted high alkali liquor may be used for dilution earlier in the cooking process in the impregnation zone (such as by conducting the spent liquor via the conduit 17 back to the impregnation vessel 1) or by addition to the cooking liquor in the concurrent zone (such as by conducting the spent liquor back to the concurrent zone B via a conduit). The resulting increased liquid-to-wood ratio is advantageous in that it reduces the variation of the effective alkali concentration in the impregnation zone A and in the concurrent cooking zone B. The use of a separate extraction screen, such as the screen section 104, used for the recovery of high alkali cooking liquor provides the added advantage of enabling the reintroduction of a portion of the extracted liquor through a central pipe and adding a liquor containing a higher concentration of effective alkali to this liquor. This high effective alkali liquor may be white liquor from the conduit 24 or excess wash liquid from the conduit 116 or a mixture thereof. This effective alkali addition provides a more uniform alkali concentration throughout the counter-current cooking zone C. More specifically, the effective alkali concentration is substantially increased in the residual phase of the delignification process by adding the effective alkali at the end of the cooking zone C. The bypassing of a portion of the wash liquid flow outside of the counter-current cooking zone C may improve the downward movement of the partially delignified raw material through the digester 6. For example, a digester that is originally designed for MCC or EMCC cooking methods already have the required separate extraction screen and can easily be converted to take advantage of the method of the present invention by using the intermediate section disposed between the main extraction screens and the MCC screen for either concurrent or counter-current cooking.

In operation, the digester system illustrated in FIG. 1 may be used as follows. The chips are fed in a conventional manner into the chip bin 20A, subsequently steamed in the vessel 20B and thereafter moved into the chute 20C. The high-pressure feeder 19 may then feed the chips together with the transport liquid via the conduit 18 to the top of the impregnation vessel 1. The temperature of the chips and the transport liquid may be about 110° C. to 120° C. at the entry of the impregnation vessel 1.

In the preferred first embodiment of FIG. 1, at least 30% of the total effective alkali (EA as NaOH) charged to the digester system may be provided to the impregnation zone A via the conduits 30 and 132 and to the concurrent zone B via the conduit 27. More preferably, about 40% to 90% of the EA is charged to the zones A and B. Most preferably, about 60% to 80% is charged to the zones A and B. More particularly, about 50% of the total EA amount charged to the digester system is charged via the conduits 30 and 132 into the impregnation zone A and about 20% of the total EA is charged via the conduit 27 to the concurrent zone B. If effective alkali is recirculated by reusing liquor extracted through the screen section 104 and passed through the conduit 17 to the impregnation zone A or the cooking zone B the alkali charges into these zones may be reduced.

In addition to the actual fibers in the wood, the latter also conveys its own moisture (the wood moisture), which normally constitutes about 50% of the original weight, to the impregnation vessel 1. Over and above this, some condense is present from the steaming, i.e., at least a part of the steam (principally low-pressure steam) which was supplied to the steaming vessel 20B is cooled down to such a low level that it condenses and is then recovered as liquid together with the wood and the transport liquid.

At the top of the impregnation vessel 1, the screw feeder 2 pushes chips from above and downwards into the impregnation vessel 1. No liquid is necessarily recirculated within the impregnation vessel. Instead, spent liquor, such as black liquor, from the second screen girdle section 104 and white liquor from the conduit 30 may be supplied to the impregnation vessel 1. The effective alkali concentration of the spent liquor withdrawn from the screen 104 may be at least 15 g/l, and, more preferably, at least 20 g/l but less than 60 g/l.

The chips which are passed through the top screen 2 then move slowly downwards in a plug flow through the impregnation vessel 1 in a liquid/wood ratio between 2/1 to 10/1; preferably between 3/1 to 8/1; and, more preferably, of about 4/1 to 6/1. As mentioned above, the black liquor, which is drawn off from the second screen girdle section 104 and the white liquor from the conduit 30, may be added at the top of the impregnation vessel 1. In this way, the black liquor and the white liquor form a combination liquor. The high temperature of the combination liquor (100° to 170° C.), preferably exceeding 130° C., more preferably between 130° to 160° C., ensures rapid heating of the chips. In addition, the relatively high pH, exceeding pH 10, of the black liquor neutralizes acidic groups in the wood and also any acidic condensate accompanying the chips, thereby counteracting the formation of encrustation, so-called scaling.

The chips, which have been thoroughly impregnated and partially delignified in the impregnation vessel 1, are then fed to the top of the digester 6 and conveyed into the top separator 7. The chips are thus fed through the screen, meanwhile free transport liquid may be withdrawn outwardly through the screen. It is to be understood that the present invention is not limited to any specific type of separator.

The chips then move down into the concurrent zone B through the digester 6 at a relatively high cooking temperature, i.e., between 130° to 185° C., preferably about 140° to 175° C., and, most preferred, about 150° to 170° C. The major part of the delignification takes place in the first concurrent cooking zone B. Laboratory tests have shown that the amount of residual lignin seems relatively independent of the temperature in the bulk phase. However, the fraction of lignin that is dissolved is surprisingly decreased to a large extent by the hydroxide ion concentration ($OH^-$) during the cooking process. Another important feature of the present invention is that only the hydroxide ion concentration and the temperature seem to have a significant influence on the rate of residual delignification that is represented by the end of the cooking zone C. An increase of hydroxide seems to substantially reduce the amount of residual lignin. Hydrosulphide ion concentration only seems to have a marginal or no effect on the rate of residual delignification. Additionally, the rate of delignification in the bulk phase is increased and the amount of residual lignin is decreased by a higher concentration of hydroxide and hydrosulphide and a lower sodium ion concentration in the bulk phase.

The retention time in this concurrent cooking zone B should be at least 20 minutes, preferably, at least 30 minutes and, more preferred, at least 40 minutes. The liquid-to-wood ratio should be at least 2/1 but should be below 7/1; preferably in the range of 3/1 to 5.5/1; and, more preferably, between 3.5/1 and 5/1.

The cooking liquor mingled with released lignin, etc., may be drawn off at the draw-off screen 8 and sent to the recovery unit 110 via both flash tanks 108, 112. The effective alkali of this spent liquor is relatively low at between about 3 g/l and about 15 g/l.

As mentioned above, a substantial amount of white liquor is preferably supplied in the lower part of the digester and moves in a counter-current direction. It can be added with the pipe 123 together with liquor extracted from the screen section 12 as it moves upwards towards the draw-off screen 104. This prolongs the delignification in the digester 6.

The temperature in the counter-current zone C is preferably between about 100° C. and about 175° C., preferably exceeding 120° C., preferably between about 130° C. and about 150° C., in order to dissolve remaining lignin. The alkali content in the lowermost part of the counter-current cooking zone C should preferably be substantially higher than at the end of the concurrent zone B. The effective alkali content in the zone C should be at least 8 g/l higher than the effective alkali content in the zone B; preferably higher than 14 g/l; more preferably higher than 30. The EA content in the zone C should not be more than 120 g/l, preferably not more than 60 g/l higher than the EA content in the zone B. It has been found in laboratory tests that an increase of hydroxide in the residual phase substantially increases the delignification rate of the residual lignin. An increase of sulphide ions does not seem to have the same profound effect on the delignification rate of the residual lignin. An increase in temperature also seems to increase the delignification rate of residual lignin. The fresh alkali is preferably introduced into the cooking zone C at the very end of the bulk phase or in the beginning of the residual phase of the delignification process. The end of the cooking zone C represents the residual phase of the delignification process. An important feature of the present invention is to increase the alkali level in the residual phase and not in the bulk phase to achieve the unique advantages of the present invention.

Washing liquid having a temperature, preferably about 50° C.–100° C., may be added via the outer annular conduit 25 disposed at the bottom of the digester 6. This liquid consequently displaces the hot liquor in the pulp upwards in counter-current and thereby imparts a desired temperature to the remaining pulp.

The quantity of white liquor that is added at the conduit 116 depends on how much white liquor possibly is added else where, but the total amount corresponds to the quantity of white liquor which is required for achieving desired delignification of the wood. Preferably a part of the white liquor is added here, which also improves the diffusion velocity, since it increases in relation to the concentration difference (chip-surrounding liquid). The partially delignified chips extra rapidly assimilate the active cooking chemicals by diffusion, since the concentration of alkali (EA as NaOH) is relatively high.

In the preferred embodiment of the present invention, between 5% and 60%; preferably between 8% and 35%; and, more preferably, between 12% and 25% of all the total white liquor is charged to the cooking liquor that is moving counter-currently through the partially delignified raw material resulting in an increase in the effective alkali concentration of about 8 to about 120 g/l NaOH, preferably about 14 g/l to about 70 g/l; and, more preferably, about 20 g/l and about 50 g/l of NaOH; and, most preferably, between 30 g/l and 40 g/l at the screen girdle section 12 of the digester 6 to achieve the desired alkali concentration in the counter-current cooking zone (C). Laboratory tests have shown that it may be desirable to keep a high H-factor in the first stage of the cooking process. The H-factor is a function of time and temperature in relation to the delignification process (degree of delignification) during the cooking process. The H-factor is used to control the delignification process of a digester, i.e. maintaining a certain H-factor principally leads to the same Kappa number of the produced pulp (remaining lignin content of the fiber material) independent of any temperature variations during the cooking process. According to the present invention, the H factor in the first concurrent cooking zone of the cooking process may be between about 30% and about 99.5%; more preferably, between about 50% and about 99%; and, most preferably, between about 60% and 98% of the total H-factor requirement for the pulp production.

The finally digested pulp is then taken out of the digester 6 into the blow-line (26) for further processing. Although the cooking process of the present invention has been described as including two distinct cooking zones B and C, it is possible to divide the cooking zone into smaller segments wherein each segment may receive an addition of an alkali charge.

It is further to be understood that the conduit 116 may have a branch conduit that is in fluid communication with the conduit 106 so that the spent liquor withdrawn from the screen girdle section 12 and the white liquor added via the conduit 24 may merge with part of the spent liquor that is withdrawn from the screen girdle section 104 and may be reintroduced through a central pipe that extends to the screen section 104.

Figure 2:
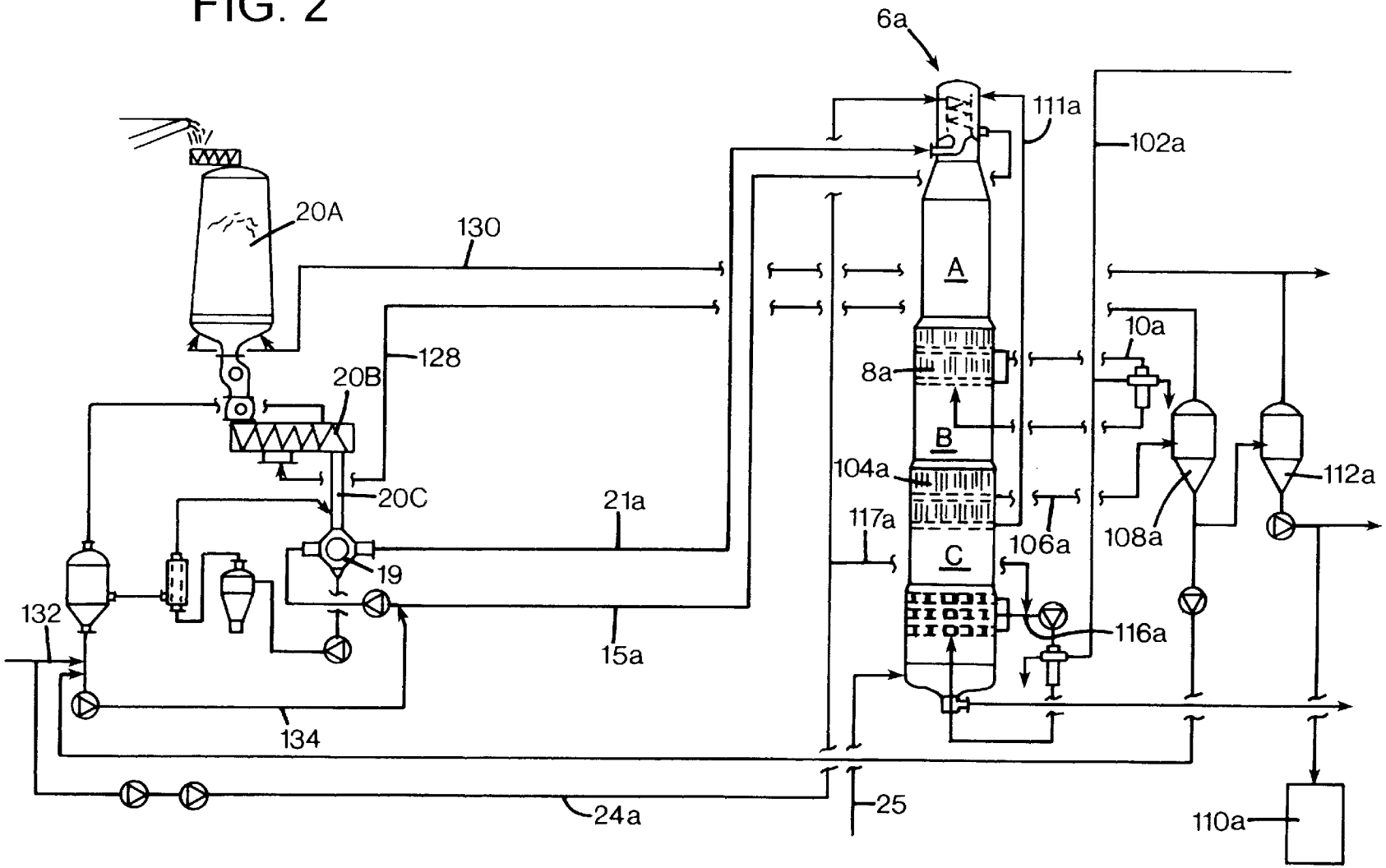
FIG. 2 is a schematic illustration of a preferred second embodiment of a continuous one vessel digesting system according to the present invention.

FIG. 2 is a schematic illustration of a second embodiment of a one vessel digesting system according to the present invention. The second embodiment is virtually identical to the first embodiment but the second embodiment does not have a separate impregnation vessel. Instead, the digester has an impregnation zone at the top of the digester. Only the most important differences are described herein. The chips and transport liquid may be conducted via a conduit 21*a* to the top of a digester 6*a*. The transport liquid is separated from the chips in the separator as described earlier and returned to the high pressure feeder via a return line 15*a*. Cooking liquor, such as white liquor, may be conducted in a cooking liquor conduit 24*a* up to the top of the digester 6*a*. The chips is treated with white liquor, and possibly cooking liquor from conduit 111a, before falling into the impregnation zone A. The temperature in the impregnation zone A is, preferably, between 100° C. and 170° C.; more preferably, between 115° C. and 145° C.; and, most preferably, between 125° C. and 140° C.

Liquor may be withdrawn at the screen girdle section 8*a* and mixed with white liquor from conduit 24*a* and conducted back into the digester 6*a* via a recirculation line 10*a*. The temperature of the spent liquor may be regulated with a heat exchanger 165*a* that is engaged to a high steam conduit 102*a*. The recirculation line may extend into the digester as a central pipe 167*a*. The effective alkali concentration of the withdrawn spent liquor is at least above 2 g/l, preferably above 4 g/l.

A second screen girdle section 104*a* may be disposed below the screen girdle section 8*a* so that a concurrent zone B is defined between the sections 8*a* and 104*a*. The temperature in the zone B may be between about 130° C. and about 185° C.; more preferably, between about 140° C. and about 175° C.; and, most preferably, between about 150° C. and 170° C.

The screen section 104*a* has an upper section and a lower section. A relatively low alkali spent liquor may be withdrawn from the upper section of the screen section 104*a* and conducted via a conduit 106*a* to the flash tank 108*a* and then forwarded to the recovery unit 110*a* as described above. A high alkali spent liquor may be withdrawn from the lower section of the screen girdle section 104*a* and conducted back to the impregnation zone A via a conduit 111*a*. The effective alkali of the spent liquor withdrawn from the upper section of the screen section 104*a* is relatively low, between about 3 g/l and about 15 g/l.

It is to be understood that part of the high alkali liquor flowing in the conduit 111*a* may be mixed with a liquor containing a higher alkali concentration such as white liquor from the conduit 24*a* or part of the liquor flowing in the conduit 116*a* and subsequently reintroduced through a central pipe that terminates at a point adjacent to the lower screen section 104*a*. The liquor flowing in conduit 116*a* that is not reintroduced through the central pipe 123*a* may either be forwarded to the recovery system 110*a* via flash tanks 108*a* and 112*a* or forwarded to the impregnation zone A or to the concurrent cooking zone B or, preferably, to the central pipe terminating adjacent to the lower screen 104*a*, or a combination of these alternatives. A part of the white liquor supplied to the system may be supplied from the conduit 24*a* to the conduit 116*a* via a branch conduit 117*a*. In the preferred second embodiment at least between 5% and 60%; preferably between 8% and 35%; and, more preferably, between 12% and 25% of all the total effective alkali charge is supplied to the conduit 116*a*. More particularly, the effective alkali at the lower end of the cooking zone C is increased by about 8 to about 120 g/l NaOH, preferably about 14 g/l; more preferably, about 20 g/l and about 50 g/l of NaOH; and, most preferably, between 30 g/l and 40 g/l.

Figure 3:
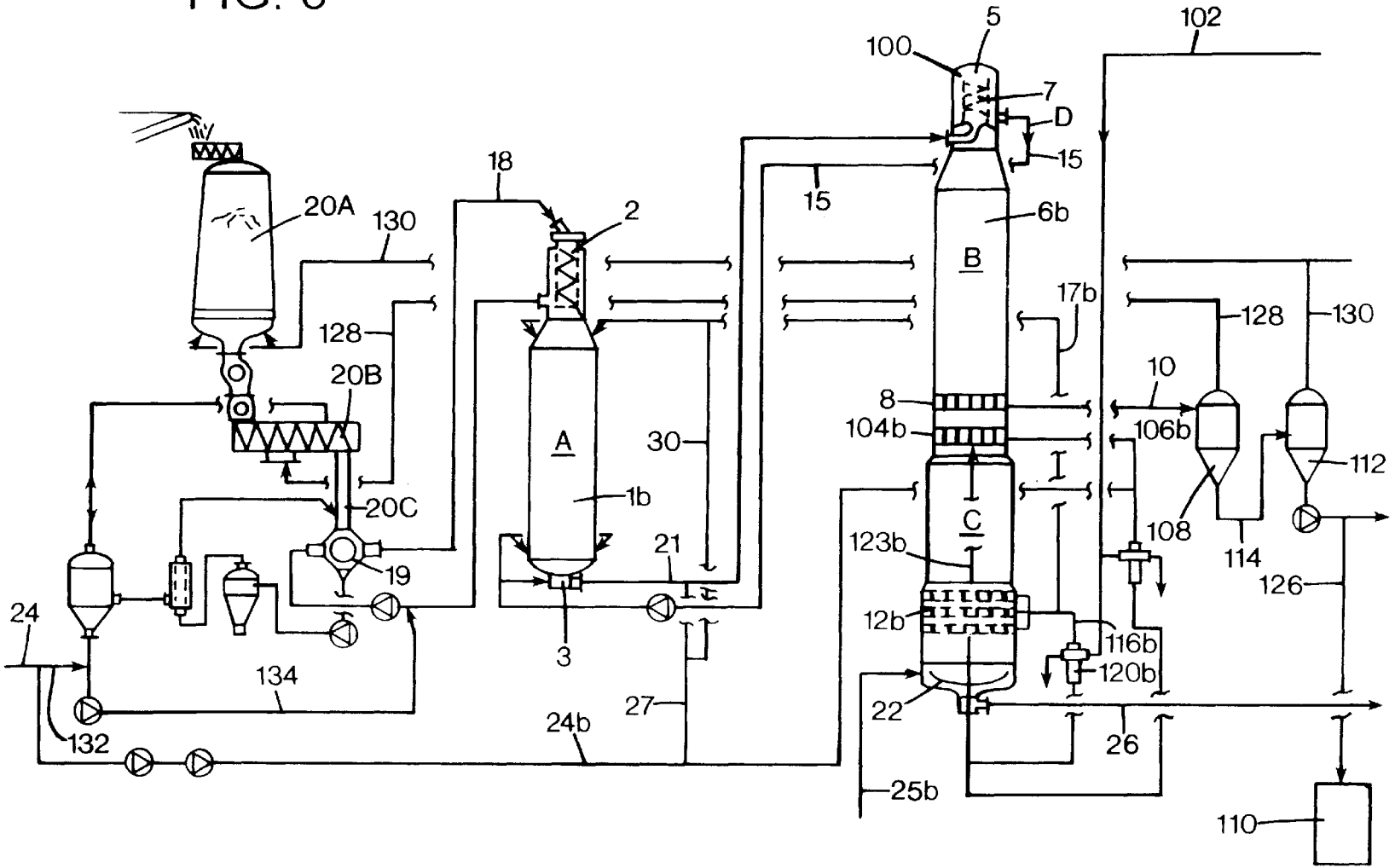
FIG. 3 is a schematic illustration of a preferred third embodiment of a continuous two vessel digesting system according to the present invention.

FIG. 3 is a schematic illustration of a third embodiment of a two vessel digesting system according to the present invention. In the third embodiment of the present invention, the final high alkali delignification stage is performed in a second concurrent cooking zone C, by adding a sufficient amount of white liquor from the conduit 24*b* to the liquor extracted through the screen 104*b* and reintroducing the liquor through a central pipe 123*b* terminating adjacent to the screen 104*b*. The third embodiment is similar to the first embodiment shown in FIG. 1. However, some of the more important differences are described herein. More particularly, the third embodiment has a digester 6*b* having two concurrent cooking zones B and C. In other words, the cooking zone C is also concurrent. In order to displace the spent liquor withdrawn from screen girdle section 104*b* is conducted via a conduit 106*b* and into the central pipe 123*b* that extends all the way from the bottom, or from the top, of the digester 6*b* to the screen girdle section 104*b*. The spent liquor withdrawn from a screen girdle section 12*b* via a conduit 116*b* may be conducted back to a top of an impregnation vessel 1*b* via a conduit 17*b*. The temperature of the liquor in the conduit 116*b* may be regulated with a heat exchanger 120*b* so that the white liquor will have the desired temperature when it enters the central pipe 123*b*. Preferably, the temperature of the cooking liquor in the conduit 116*b* is between about 100° C. and about 175° C., preferably exceeding 120° C., and, most preferably, about 130° C. and 150° C. The remaining portions of this embodiment are virtually identical to the first embodiment. A washing liquid may be added via a conduit 25*b* at the bottom of the digester 6*b*. The washing liquor, preferably having a temperature of 50° C. to 100° C., displaces the cooking liquor in the pulp and, thereby, imparts a desired temperature to the remaining pulp. In this way, the spent liquor together with the washing liquid is extracted at the screen girdle section 12*b* after they have passed counter-currently through the final wash section and reusing the residual alkali and sulfidity content in the impregnation stage or in a previous cooking stage. The white liquor addition to the beginning of the concurrent cooking zone C should preferably be about between 16% and about 100%; more preferably between about 28% and about 100%; and, most preferably, between about 40% and 90% of the total white liquor charged to the digesting system. This white liquor charge results in an increase in effective alkali concentration of between about 8 and 60 g/l NaOH; preferably between about 14 g/l and about 60 g/l; more preferably, between about 20 g/l and about 50 g/l; and, most preferably, between about 30 g/l and 40 g/l NaOH at the point of addition. Similar to the embodiments described above, the temperature in the concurrent cooking zone C is between about 100° C. and about 175° C., preferably exceeding 120° C., and, most preferably, about 130° C. and 150° C. The temperature in the concurrent zone B is about between 130° C. and about 185° C., preferably about 140° C. to 175° C., and, most preferably, between about 150° C. and about 170° C.

The method and device of the present invention are not restricted to continuous process and may also be used in a batch digester. In a batch digester, the invention may be implemented by charging the lignocellulosic raw material into the digester. The raw material may then be steamed in order to facilitate the liquor penetration and charging cooking liquor from a previous high alkali stage, possibly with the addition of some fresh white liquor and increasing the temperature to full cooking temperature. When a predetermined H-factor is reached, preferably exceeding 30%; more preferably, exceeding 50%; and, most preferably, exceeding 60% of the total H-factor required for pulp formation, a substantial fraction of the total white liquor charge may be added to either increase the liquor to wood ratio or to displace some of the cooking liquor used in the first stage. It is to be understood that the H-factor in the second cooking stage may be 100% minus whatever the H-factor is in the first cooking stage or stages if the first stage is separated into smaller segments. In this way, the effective alkali concentration in the second stage may be and about 8 g/l and 60 g/l NaOH; preferably about 14 g/l and 60 g/l; and, more preferably, between about 20 g/l and 50 g/l of NaOH higher than the effective alkali level before the addition. When the pulp has reached the desired lignin content, the cooking process is terminated either by displacing with cold wash filtrate or by releasing the pressure and blowing the cook to a blow tank. The pulp may then be washed in a conventional washing equipment.

The cooking liquor used in the first cooking stage that is displaced when the fresh white liquor is charged may suitably be forwarded to the recovery system. The free cooking liquor in the first stage may be drained and forwarded to the recovery system before the white liquor addition, thereby decreasing the liquor-to-wood ratio, which leads to a larger increase in effective alkali concentration for a given white liquor charge. The liquor with a high concentration of effective alkali that is produced when the second cooking liquor is washed from the pulp may also be forwarded to the recovery system, or it may be used in the first cooking stage of a subsequent batch, or it may be used in the second cooking stage of a subsequent batch, or it may be used to impregnate the lignocellulosic material prior to the first cooking stage of a subsequent batch, or a combination of the mentioned uses.

Figure 4:
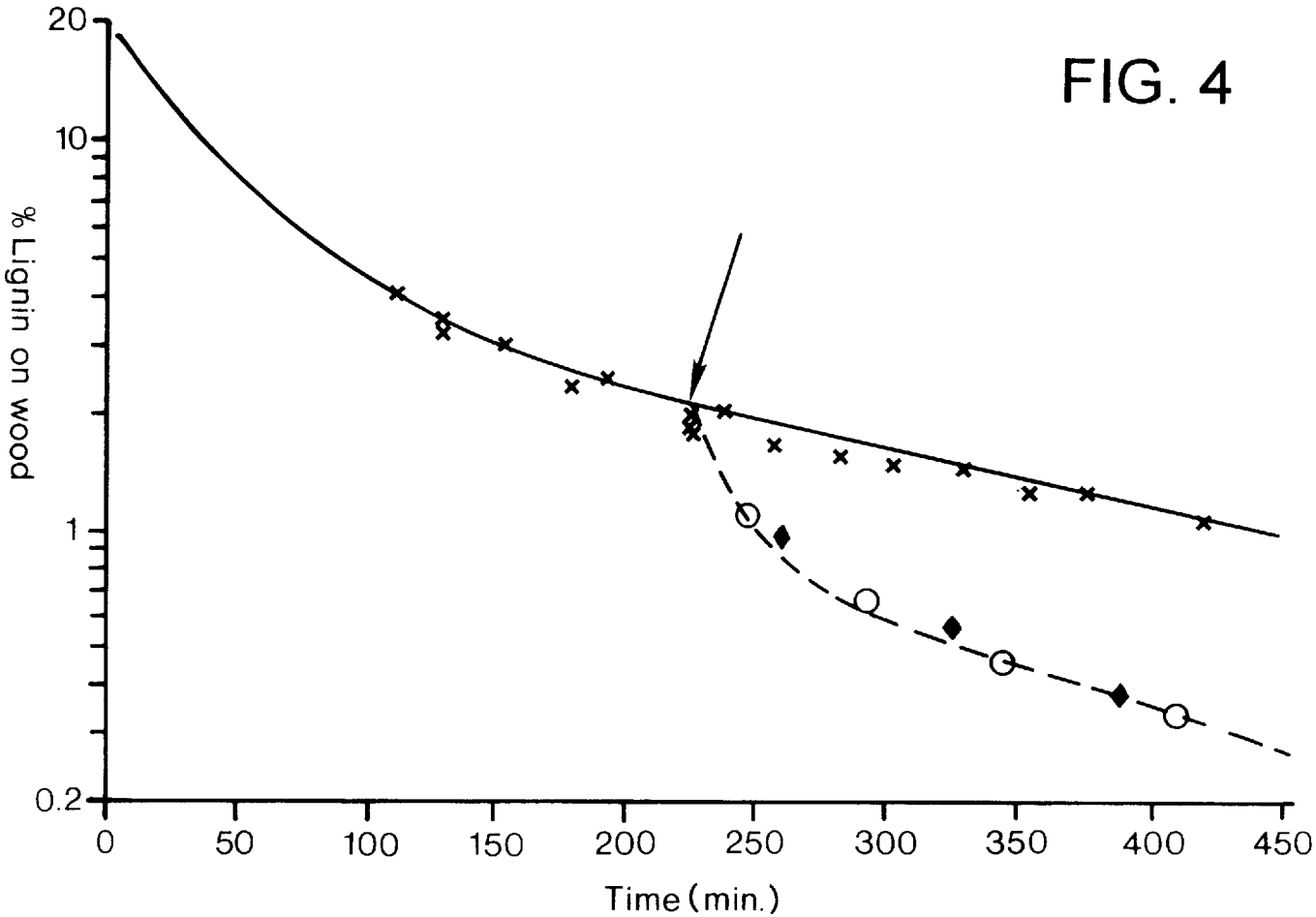
FIG. 4 is a diagram showing the advantages of the present invention related to the lignin removal.

FIG. 4 illustrates the delignification process using the cooking process of the present invention. The cooking was carried out at an effective alkali concentration of 4 g/l (shown as a solid line) measured as NaOH. The dashed line shows the effect of increasing the effective alkali concentration from 4 to 36 g/l as NaOH in the residual phase on the amount of the remaining lignin. After about 225 minutes, when the alkali concentration was increased, the lignin on wood ratio was dramatically reduced. The rate of reduction was similar to that of bulk phase delignification.

The rate and extent of the rapid lignin dissolution that occurred when the concentration of effective alkali was increased was substantially unaffected by the concentration of hydrosulphide ions. If there are provisions in the recovery system to produce white liquors with different sulfidities then a liquor with low sulfidity may be used in the final high alkali stage and the liquors containing more hydrosulphide ions may with advantage be used earlier in the cooking process where a high hydrosulphide concentration is advantageous in terms of delignification and selectivity.

Figure 5:
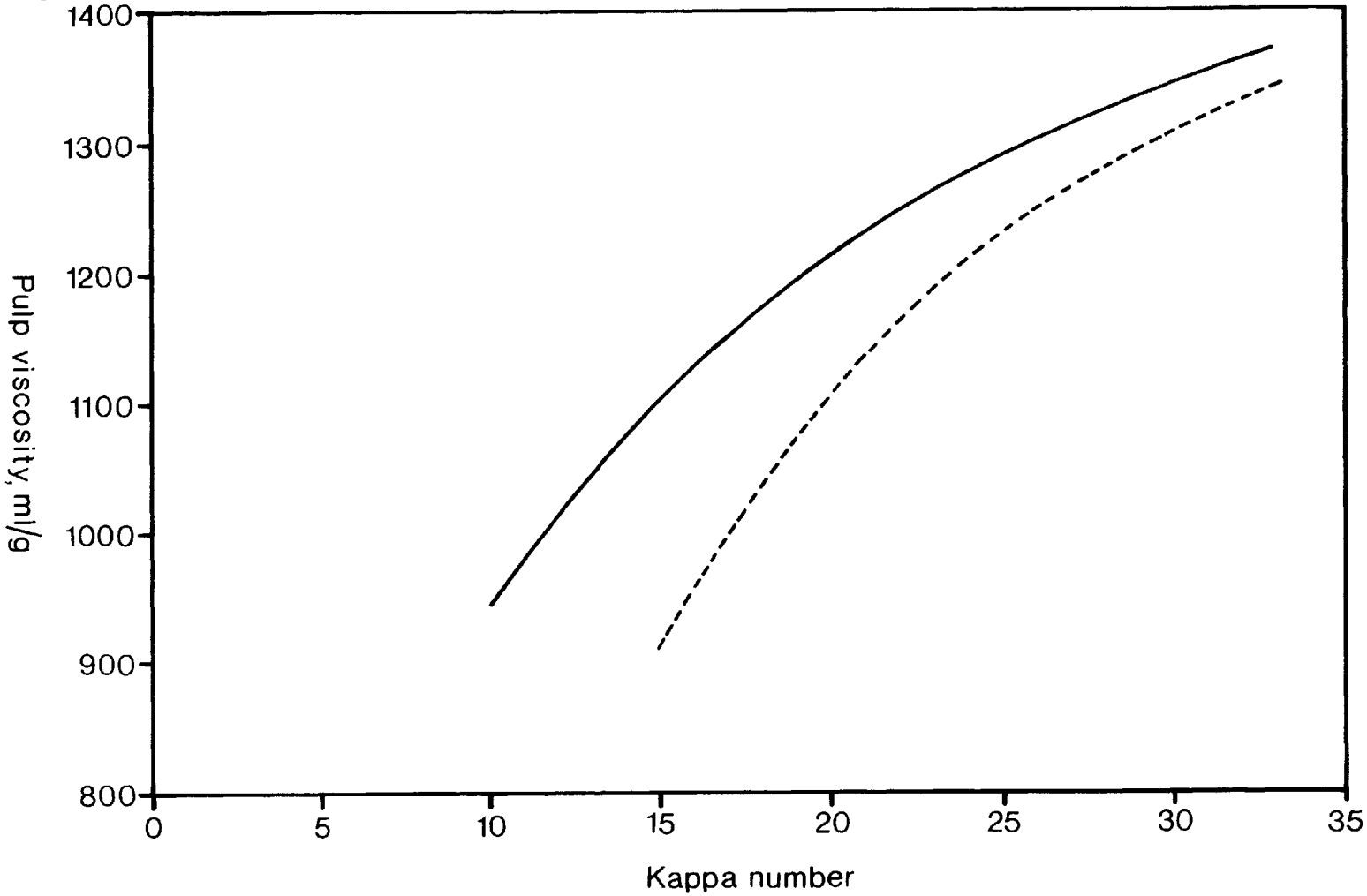
FIG. 5 is a diagram showing the advantages of the present invention related to pulp viscosity and Kappa number.

FIG. 5 shows the improvement in pulp strength, measured as pulp viscosity, that is achieved with the process of the present invention. The solid line lines shows the value of pulp produced with the present invention and the dotted lines is the pulp strength achieved with a conventional but state of the art ITC process. These results were developed by using an effective alkali of about 6 g/l at a temperature of about 163° C. for about 3.5 hours when using the method of the present invention. In the second stage of the present invention, the effective alkali concentration was increased to about 40 g/l at a temperature of about 160° C. for about 1 hours. The results from this cooking example was compared to the ITC process using an effective alkali concentration of about 14 g/l at a temperature of about 163° C. for about 4.5 hours. The pulp viscosity improved with the present invention. For example, the pulp viscosity is about 1220 ml/g for the present invention compared to only 1100 ml/g for a conventional ITC process at a kappa number of 20. This represents a pulp viscosity increase of about 10%.

Figure 6:
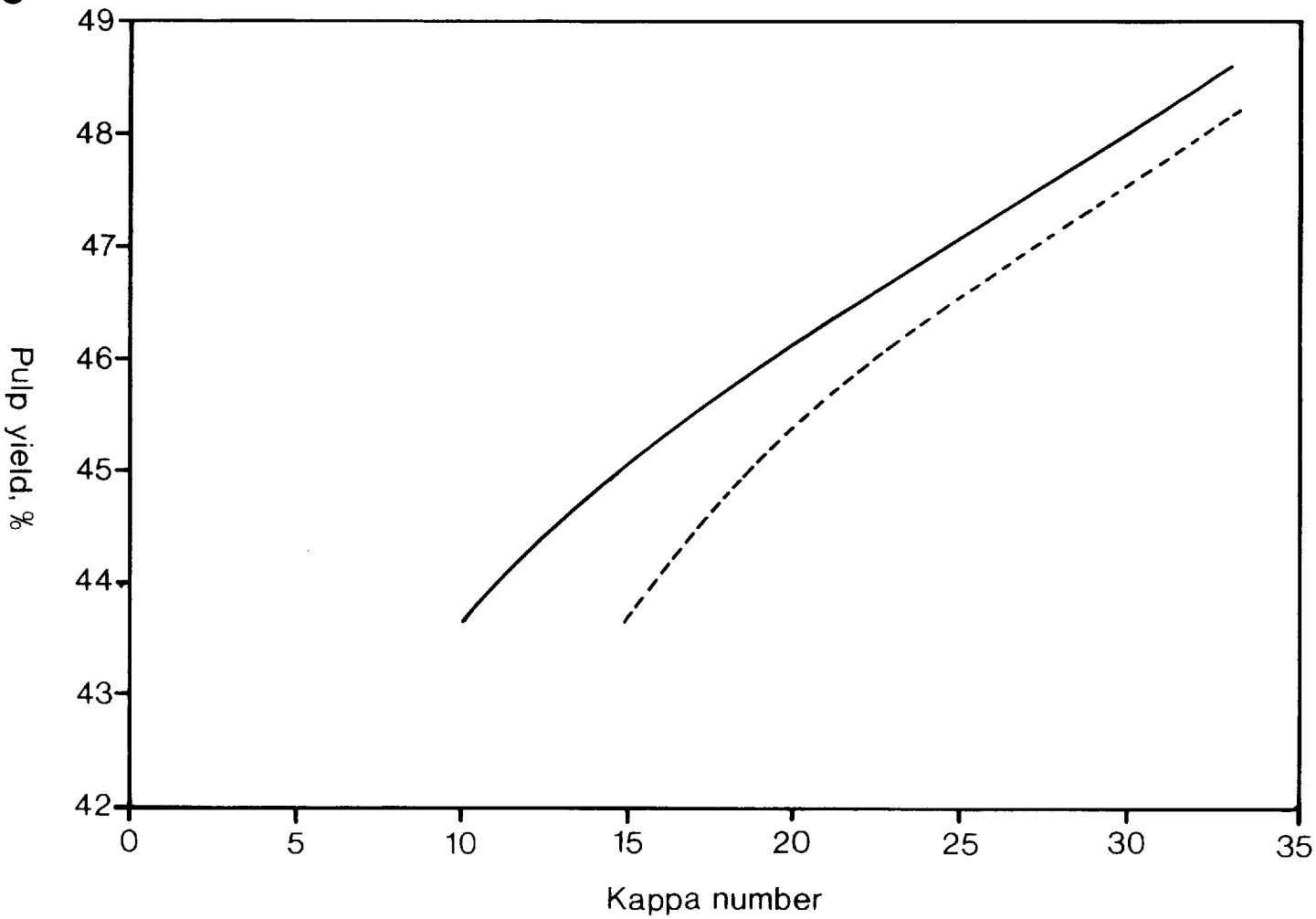
FIG. 6 is a diagram showing the advantages of the present invention related to pulp yield and Kappa number.

FIG. 6 illustrates the improvement in pulp yield that is achieved with the process of the present invention. This pulp yield is based on the same example as the example illustrated in FIG. 5. The solid line lines shows the value of pulp produced with the present invention and the dotted lines is the pulp yield achieved with a conventional but state of the art ITC process. For example, at a kappa number of about 20, the pulp yield of the present invention is about 46.2% compared to slightly over 45.4% for a conventional ITC process.

It is to be understood that the number of screen girdles shown is in no way limiting for the invention but, instead, the number can be varied depending on different requirements. Additionally, the shown system in front of the digester is in no way limiting to the invention, e.g., it is possible to exclude the steaming vessel 20 and have a direct connection between the chip bin (for example, a partly filled atmospheric vessel) and the chip chute. Furthermore, other kinds of feeding systems than an HP-feeder may be used, e.g., DISCFLO™-pumps).

Additionally, the invention is not limited to kraft cooking, but may also be applied to soda, soda anthraquinone and draft anthraquinone cooking.

In a separation study, spruce wood chips were delignified according to the ITC process with 13 g/l of effective alkali for 4.5 hours at 162° C. reaching a kappa number in the range of 25 with a viscosity of 1066 ml/g. If the alkali concentration was increased by 8 g/l during the last 1 hour and the temperature at the same time decreased to 151° C. during the final hour the pulp produced had a similar lignin content as the ITC pulp but with a 3% higher viscosity of 1098 ml/g. If the alkali concentration was increased by 27 g/l instead during the final hour the temperature had to be decreased to 141° C. in order to reach the same lignin content and the viscosity of the pulp became 1110 ml/g instead.

While the present invention has been described in accordance with preferred compositions and embodiments, it is to be understood that certain substitutions and alterations may be made thereto without departing from the spirit and scope of the following claims.

We claim:

1. A method for producing pulp, comprising the steps of:

providing a fiber material, a transport liquid and an impregnation zone;

providing a digester to facilitate a cooking reaction, the digester having at least one screen girdle section disposed therein, the digester having a first cooking zone and a second cooking zone;

providing a total amount of cooking liquor required for the cooking reaction;

transporting the fiber material and the transport fluid to the impregnation zone;

heating and impregnating the fiber material disposed in the impregnation zone;

transferring the heated and impregnated fiber material from the impregnation zone to the first cooking zone;

supplying a first portion of the total amount of the cooking liquor to the impregnation zone and the first cooking zone;

obtaining a first effective alkali concentration in the first cooking zone;

passing the fiber material and the cooking liquor through the first cooking zone; and supplying a second portion of the total amount of the cooking liquor to the second cooking zone to obtain a second effective alkali concentration in the second cooking zone, the second alkali concentration being between about 8 grams/liter and about 120 grams/liter greater than the first effective alkali concentration.

2. The method according to claim 1 wherein the method is a continuous process.

3. The method according to claim 1 wherein the method further comprises the steps of withdrawing a spent liquor from the screen girdle section and transferring the spent liquor to the impregnation zone.

4. The method according to claim 1 wherein the second alkali concentration is at least about 14 grams/liter greater than the first effective alkali concentration.

5. The method according to claim 1 wherein the second alkali concentration is between about 20 grams/liter and about 50 grams/liter greater than the first effective alkali concentration.

6. The method according to claim 1 wherein the second alkali concentration is between about 30 grams/liter and about 40 grams/liter greater than the first effective alkali concentration.

7. The method according to claim 1 wherein the second effective alkali is between about 14 g/l and about 70 g/l.

8. The method according to claim 7 wherein the second effective alkali is between about 20 g/l and about 50 g/l.

9. The method according to claim 1 wherein the first portion is at least 40% of a total amount of effective alkali charged.

10. The method according to claim 1 wherein the second portion is at least 30% of a total amount of the effective alkali charged.

11. The method according to claim 1 wherein the first cooking zone is heated to a first temperature and the second cooking zone is heated to a second temperature, the first temperature being greater than the second temperature.

12. The method according to claim 1 wherein the first temperature is at least 20° C. greater than the second temperature.

13. The method according to claim 1 wherein the first temperature is between about 150° C. and about 170° C.

14. The method according to claim 1 wherein the second temperature is between about 130° C. and about 150° C.

15. The method according to claim 1 wherein the second cooking zone is a counter-current cooking zone.

16. The method according to claim 1 wherein the second cooking zone is a concurrent cooking zone.

17. The method according to claim 16 wherein the second portion is between about 16% and about 100% of a total amount of effective alkali charged.

18. The method according to claim 17 wherein the second portion is between about 28% and about 100% of the total amount of effective alkali charged.

19. The method according to claim 18 wherein the second portion is between about 40% and about 90% of the total amount of effective alkali charged.

20. The method according to claim 1 wherein the first cooking zone has an H-factor that is between about 30% and about 99.5% of a total H-factor required for a pulp formation.

21. The method according to claim 1 wherein the first cooking zone has an H-factor that is between about 50% and about 99% of a total H-factor required for a pulp formation.

22. The method according to claim 1 wherein the first cooking zone has an H-factor that is between about 60% and about 98% of a total H-factor required for a pulp formation.

23. A method for producing pulp, comprising the steps of:

providing a total amount of cooking liquor;

providing a digester containing a fiber material to facilitate a cooking reaction;

supplying a first portion of the total amount of the cooking liquor to the digester;

obtaining a first effective alkali level in the digester;

heating the fiber material disposed in the digester to a first temperature;

cooking the fiber material in a first cooking stage to initiate a pulp formation, the first cooking stage having an H factor that is between about 60% and about 98% of a total H-factor required to complete the pulp formation;

completing the first cooking stage;

supplying a second portion of the total amount of the cooking liquor to a second cooking stage;

obtaining a second effective alkali level in the second cooking stage, the second effective alkali level being between about 8 grams per liter and about 60 grams per liter greater than the first effective alkali level; and cooking the fiber material from the first cooking stage at a second temperature until the pulp formation is completed.

24. The method according to claim 23 wherein the method further comprises the steps of withdrawing a spent liquor after the first cooking stage and using the spent liquor to pre-treat the fiber material prior to the second cooking stage.

25. The method according to claim 23 wherein the method further comprises the step of terminating the second cooking stage by introducing a washing liquid into the digester and the washing liquid has a temperature that is lower than the second temperature.

* * * * *